United States Patent [19]

Takanobu

[11] Patent Number: 5,008,589

[45] Date of Patent: Apr. 16, 1991

[54] ELECTRON GUN AND METHOD FOR MANUFACTURING THE SAME

[75] Inventor: Hiroshi Takanobu, Mobara, Japan

[73] Assignee: Hitachi, Ltd., Tokyo, Japan

[21] Appl. No.: 451,805

[22] Filed: Dec. 18, 1989

[30] Foreign Application Priority Data

Dec. 26, 1988 [JP] Japan ..... 63-325832

[51] Int. Cl.[5] ..... H01J 29/48

[52] U.S. Cl. ..... 313/456; 313/457; 313/482; 445/34; 65/59.1; 65/59.7

[58] Field of Search ..... 313/417, 451, 456, 457, 313/482; 445/34; 65/59.1, 59.32, 59.33, 59.34, 59.7

[56] References Cited

U.S. PATENT DOCUMENTS 3,069,400 9/1971 Marks et al. ..... 313/417
4,063,340 12/1977 Blumenberg et al. ..... 445/34
4,855,639 8/1989 Van Eck ..... 313/417

FOREIGN PATENT DOCUMENTS 52-42052 3/1977 Japan .
0106352 8/1981 Japan ..... 445/34

*Primary Examiner*—Donald J. Yusko

*Assistant Examiner*—N. D. Patel

*Attorney, Agent, or Firm*—Antonelli, Terry, Stout & Kraus

[57] ABSTRACT

The present invention relates to an electron gun retaining a cathode and a plurality of electrodes with a pair of bead glasses and a method for manufacturing the same, wherein each of the bead glasses are provided with a convex portion at a position where a bead support for an electrode is buried on a side of the electrodes, each of bead bases of a beading apparatus on which the bead glasses are disposed is formed with a concave portion at a position corresponding to the convex portion of the bead glass, the bead glasses disposed on the bead bases are heated and softened, the bead supports for the cathode and the plurality of electrodes are buried and secured in the bead glasses, and the bead glasses each include convex portions on a side opposite to the electrodes. In accordance with the present invention, recesses and projections over the surfaces of the bead glasses on the electrode sides are reduced in size, thereby further increasing a supporting strength of the electrodes, preventing withstand voltage deterioration of the electron gun, and maximizing a yield in a manufacturing process of the electron gun.

8 Claims, 5 Drawing Sheets

ELECTRON GUN AND METHOD FOR MANUFACTURING THE SAME

BACKGROUND AND RELATIVE ART

The present invention relates to an electron gun and a method for manufacturing the same, and more particularly, to a beading method for burying a plurality of electrodes in bead glasses and an electron gun manufactured by this method.

In general, an electron gun is composed of a plurality of electrodes. An inline-type electron gun has such a particular construction that a plurality of electrodes are buried and securely held in bead glasses in order to precisely manufacture an assembly of the red, green and blue electrodes in order.

Referring to FIG. 4, a beading apparatus for burying the plurality of electrodes in the bead glasses is so arranged that bead base 3 each including a stopper 2 for supporting the bead glass 1 are respectively fixed on the top ends of two arms 4, which two arms 4 are in turn arranged to be brought into an opening/closing movement by an arm driving means not shown while each of them are being swirled or moved in parallel relation with each other, or while they swirls and moves in parallel simultaneously. The beading apparatus also includes a heating means (not shown) for heating and softening the bead glasses 1 which are supported by the bead bases 3.

The bead glasses 1 are mounted on the bead bases 3, prior to being heated and softened at a temperature in the vicinity of a melting point of approximately 1200° C. The bead glasses 1 are then pressed against the ends of the plurality of electrodes 6 assembled on a beading jig 5 so as to bury these ends of the electrodes thereinto. Succeedingly, the bead glasses are brought back into a condition that they are at a normal temperature, thereby completing fixture of the plurality of electrodes in the bead glasses.

The same kind of apparatus as the above is disclosed in Japanese Utility Model Laid-open Publication No. 52-42052.

In a certain conventional bead glass 1, there is provided a rectangular parallelepiped glass 10 as shown in FIG. 10A or a glass 11 of FIG. 11A having a convex portion 11*a* on the side which is not in contact with a $G_4$-electrode as shown in FIG. 11A. In a case of the glass 10 of FIG. 10A, a bead base 3 having a flat surface where the glass is mounted, is employed as shown in FIG. 10B. On the contrary, in a case of the glass 11 of FIG. 11A, a bead base 3 provided with a concave portion 3*a* for receiving the convex portion 11*a* of the glass 11 is employed as shown in FIG. 11B. When the glasses 10 of FIG. 10A are applied to a beading process as described in FIG. 4 by means of the bead bases 3 shown in FIG. 10B, an electron gun illustrated in FIG. 10C can be obtained. Similarly, the glasses 11 of FIG. 11A are applied to the beading process by means of the bead bases 3 shown in FIG. 11B in order to manufacture an electron gun illustrated in FIG. 11C.

Additionally, in FIGS. 10C and 11C, a reference numeral 20 designates a cathode body structure, and reference numerals 21 to 26 designate $G_1$-electrode, $G_2$-electrode, $G_3$-electrode, $G_4$-electrode, $G_5$-electrode and $G_6$-electrode, respectively.

SUMMARY OF THE INVENTION

As be clearly understood from FIGS. 10C and 11C, the electron gun manufactured by the above-mentioned conventional art has such a construction that when a bead support portion 24*a* for the thick plate-like $G_4$-electrode is buried in the inner surfaces of the melted bead glasses, the surfaces are largely concaved, owing to surface tensions of the bead glasses 10, 11 softened at a high temperature and characteristics of surfaces of the metallic cathode body structure 20 and the electrodes 21 to 26, and that the portions of the bead glasses extruded by burying the bead support portion 24*a* in the bead glasses are formed into large projections 30, 31 on the surfaces of the electrode sides. The thicknesses of bead support portions for the cathode structure body 20, the $G_1$, $G_2$, $G_3$-electrodes 21, 22, 23, and the $G_5$ and $G_6$-electrodes 25 and 26 are thin, and the extents of recesses and projections of the bead glasses caused by burying the bead supports in the bead glasses remain small in size, thereby resulting in no problem.

As mentioned above, if the recesses and the projections 30, 31 are largely extended, a strength for supporting the electrodes is often weakened. The electrodes cannot be thus rigidly retained with certain space-intervals therebetween. This causes a deterioration in a focus performance of the electron gun. In the knocking process during manufacture of color cathode-ray tubes, because the anode electrodes are subjected to a high voltage of 60~70 kV, if the recesses and the projections 30, 31 are largely formed at an extent as described above, unfavorable sparks are frequently generated close to the anode electrodes via the projections from the low-voltage electrodes, and a failure of the electron gun in the withstand voltage deterioration is thus inevitable. This failure decreases a yield in the manufacturing process of the electron gun.

An object of the present invention is to provide an electron gun and a method for manufacturing the same, in which the recesses and the projections on the surfaces of the bead glasses on the electrode sides are reduced in size.

The above object is achieved by providing each bead glass with a convex portion on a portion where a bead support for at least one electrode is buried on the electrode side, providing each bead base of a beading apparatus where the bead glass is disposed, with a concave portion on a portion corresponding to the convex portion of the bead glass, burying and securing bead supports for a cathode and a plurality of electrodes in the bead glasses after heating and softening the bead glasses disposed on the bead bases, and forming a convex portion on a side of each bead glass opposite to the electrode.

When the bead supports for the electrodes are buried in the heated and softened bead glasses, portions of the glasses extruded by the bead support which corresponds to the concave portions of the bead bases are received in the concave portions of the bead bases, so that the extents of the projections of the glasses can be minimized. Further, since the convex portion defined on the electrode side of each bead glass serves to fill up the recess on the interface where the bead support is buried, the recess is also reduced in size.

The above and other objects, features and advantages of the present invention will become more apparent from the following description when taking in conjunction with the accompanying drawings in which preferred embodiments of the present invention are shown by way of illustrative examples.

BRIEF DESCRIPTION OF THE DRAWINGS

FIGS. 10A, 10B and 10C are explanatory views, specifying the well-known conventional art, in which FIG. 10A is a perspective view of the bead glass, FIG. 10B is a front view of the bead base on which the bead glass is mounted, and FIG. 10C is a front view of the conventional-type electron gun; and FIGS. 11A, 11B and 11C are explanatory views, specifying another conventional art, in which FIG. 11A is a perspective view of the bead glass, FIG. 11B is a front view of the bead base on which the bead glass is mounted, and FIG. 11C is a front view of the electron gun.

DETAILED DESCRIPTION OF THE PREFERRED EMBODIMENTS

Figure 10A:
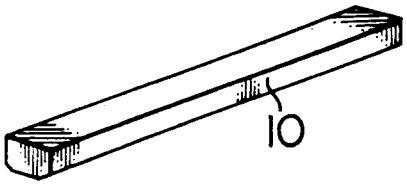
FIG. 10A PRIOR ART
Figure 10B:
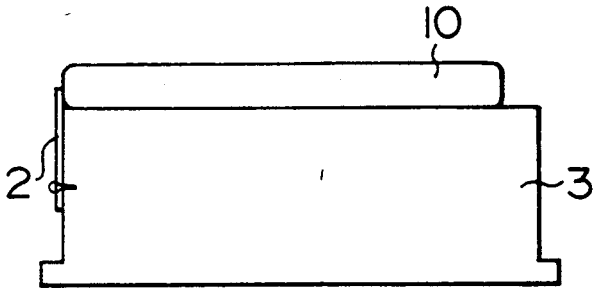
FIG. 10B PRIOR ART
Figure 10C:
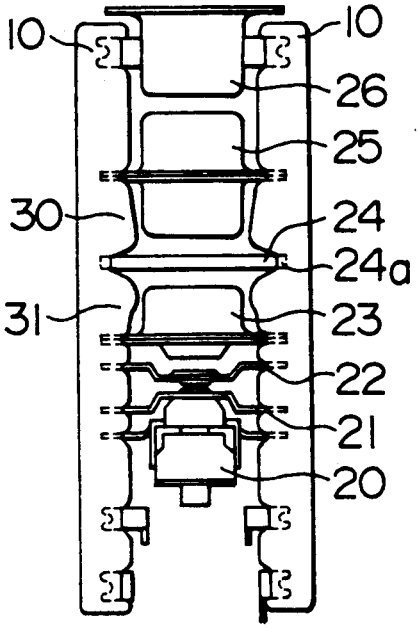
FIG. 10C PRIOR ART
Figure 11A:
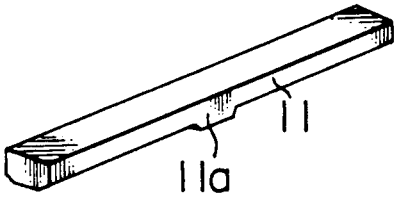
FIG. 11A PRIOR ART
Figure 11B:
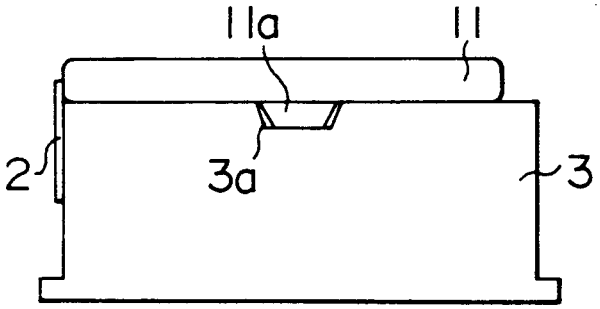
FIG. 11B PRIOR ART
Figure 11C:
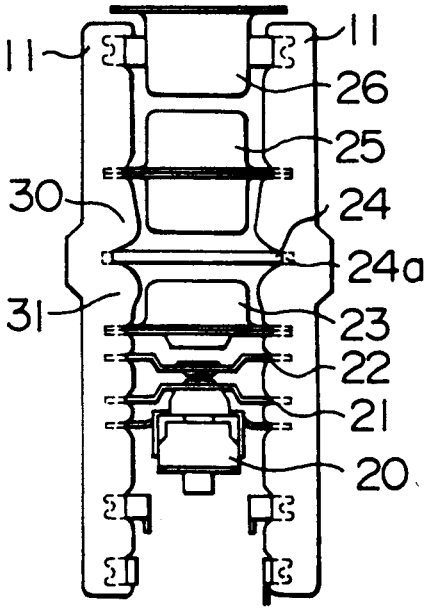
FIG. 11C PRIOR ART

A first embodiment of the present invention will be described hereinafter with reference to FIGS. 1 to 3. Reference numerals used in the first embodiment will be applied to the same members in FIGS. 10 to 11 as those in FIGS. 1 to 3, and accordingly, the parts explained in FIGS. 1 to 3 are unnecessary to be explained again.

Figure 1:
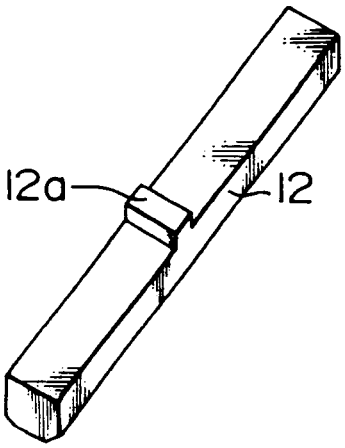
FIG. 1 is a perspective view of a bead glass used in a first embodiment of the present invention.
Figure 3:
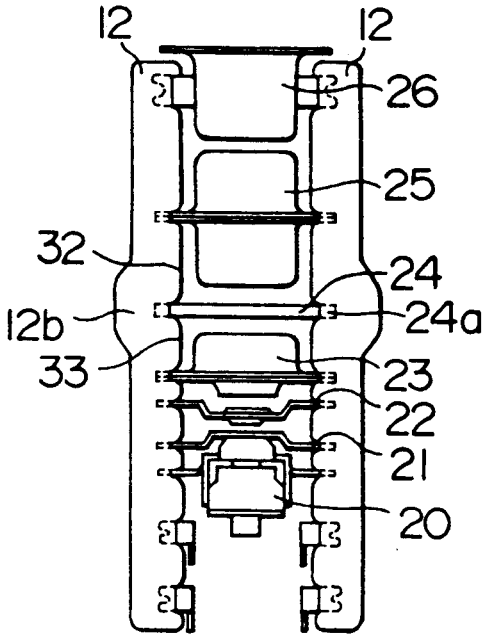
FIG. 3 is a front view showing an electron gun of the first embodiment manufactured by a method according to the present invention.
Figure 2A:
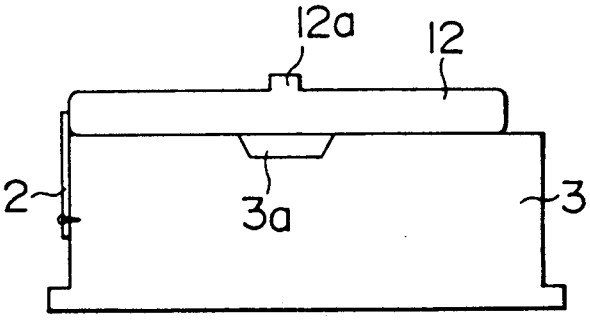
FIGS. 2A and 2B are respectively a front view and a perspective view of a bead base used in the first embodiment of the present invention, the bead base shown in FIG. 2A including the bead glass mounted thereon.
Figure 2B:
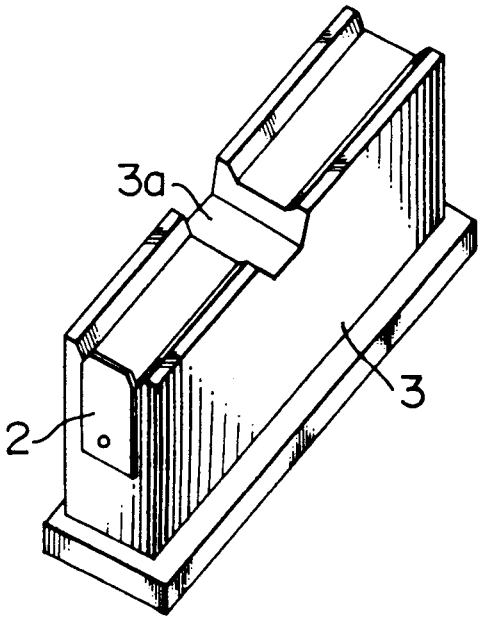

As shown in FIG. 1, a bead glass 12 before being subjected to a beading process is provided with a convex portion 12*a* on an inner surface thereof corresponding to a $G_4$-electrode 24, which will be shown in FIG. 3. As shown in FIG. 2, a bead base 3 is formed with a concave portion 3*a* on a portion thereof which corresponds to the convex portion 12*a* of the bead glass.

Figure 4:
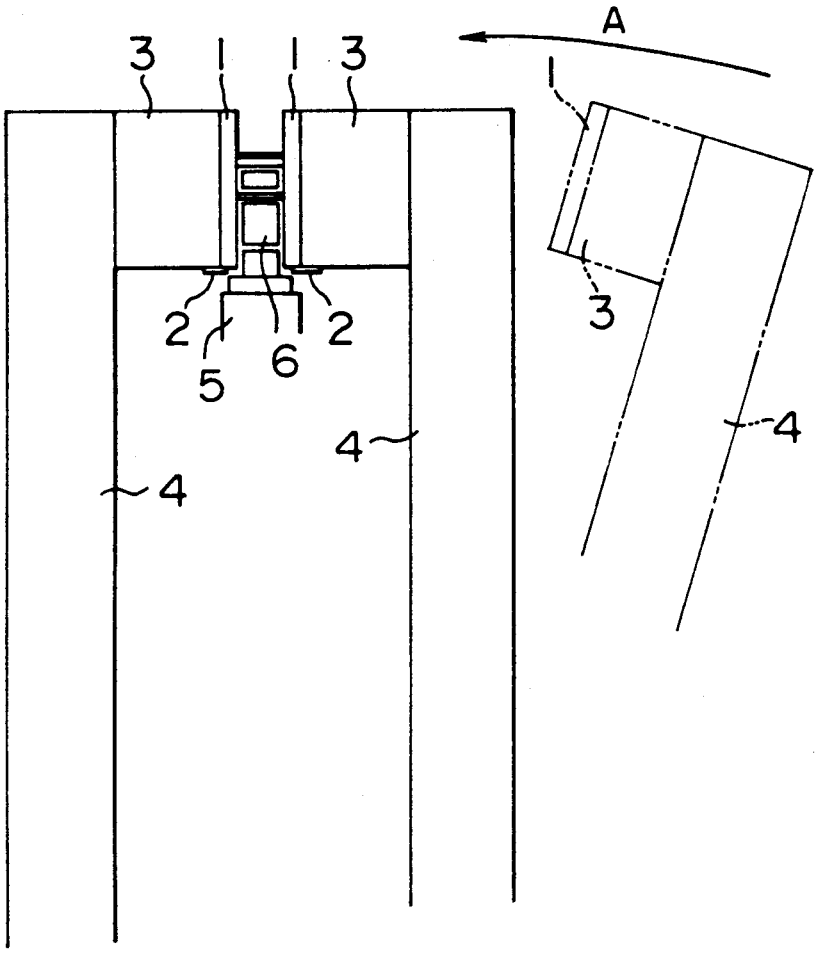
FIG. 4 is a front view partially showing a main portion of a beading apparatus in a closed condition.

A beading process is carried out by a method similar to the method having been described with reference to FIG. 4, while employing the bead glasses 12 and the bead bases 3 which are arranged in the above-mentioned manner. As a result, an electron gun having a structure, as shown in FIG. 3, can be obtained. Specifically speaking, when bead supports for a cathode 20 and electrodes 21 to 26 are buried in the bead glasses 12 having been heated and softened, portions of the glasses extruded by a bead support 24*a* are inevitably extruded into the concave portions 3*a* of the bead bases 3. Convex portions 12*b* are thus formed on the outsides of the bead glasses 12. In this case, the configurations having a recess and projections 32, 33 on the buried interface of each bead glass 12 in the vicinity of the bead support 24*a* are observed, but the portion of the glass extruded by the bead support 24*a* flows into the concave portion 3*a* of the corresponding bead base 3, as described above, so that an extent of the projection is minimized. At the same time, since the convex portion 12*a* formed on the bead glass on the electrode side serves to fill up the recess on the buried interface of the bead glass 12, the size of the recess is minimized.

In the first embodiment described above, although the convex portions 12*a* of the bead glasses 12 and the concave portions 3*a* of the bead bases 3 are formed on the portions corresponding to the bead support 24*a* of the $G_4$-electrode 24, there of course may be provided with convex and concave portions on remaining portions in alignment with the bead supports of the other electrodes.

Figure 5:
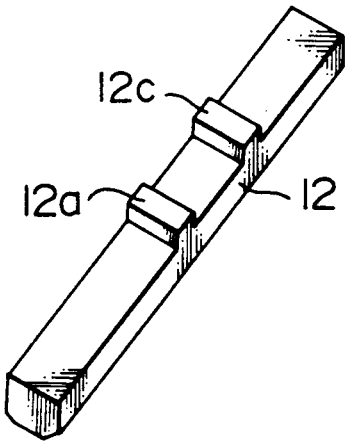
FIG. 5 is a perspective view of a bead glass used in a second embodiment according to the present invention.
Figure 6A:
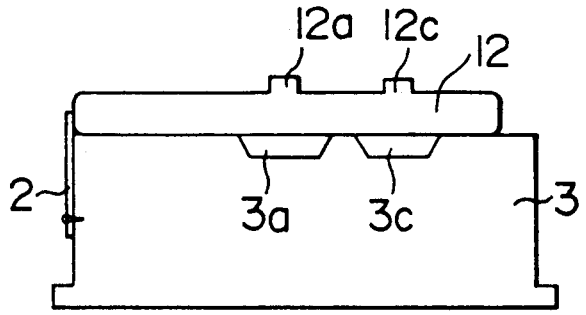
FIGS. 6A and 6B are respectively a front view and a perspective view of a bead base used in the second embodiment of the present invention, the bead base shown in FIG. 6A including the bead glass mounted thereon.
Figure 6B:
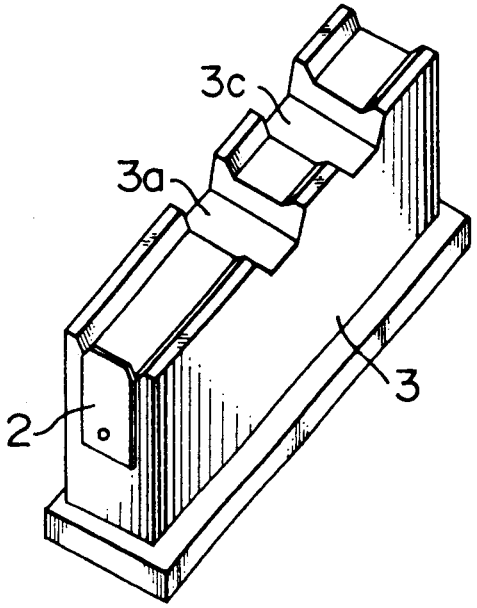
Figure 7A:
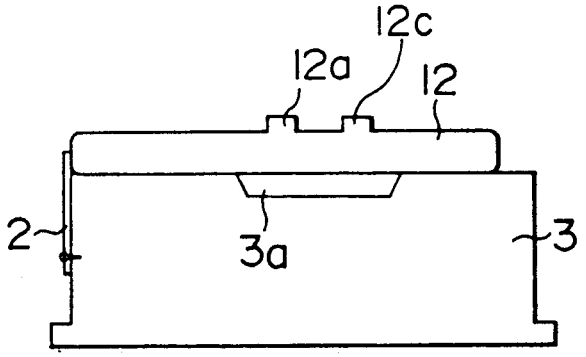
FIGS. 7A and 7B are respectively a front view and a perspective view showing a modified bead base to the second embodiment in FIG. 5, similar to FIGS. 6A and 6B, the bead base shown in FIG. 7A including the bead glass mounted thereon.
Figure 7B:
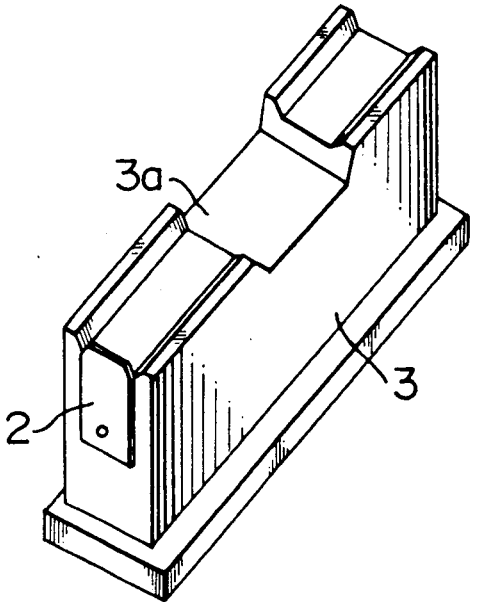

Alternatively, FIGS. 5 to 8 show a second embodiment. In the illustrated second embodiment, each bead glass can be provided with two convex portions in contrast to the first embodiment. Referring to FIG. 5, a bead glass 12 prior to a beading process includes two convex portions 12*a* and 12*c* on the inner surface of the bead glass corresponding to the electrodes. Referring to FIG. 6, a bead base 3 is formed with two concave portions 3*a* and 3*c* each of which corresponds to the respective two convex portions of the bead glass. FIG. 7 illustrates a modification of the second embodiment in FIG. 5, in which a bead base 3 is formed with a concave portion 3*a* which is large enough to receive both two convex portions of the bead glass.

Figure 8:
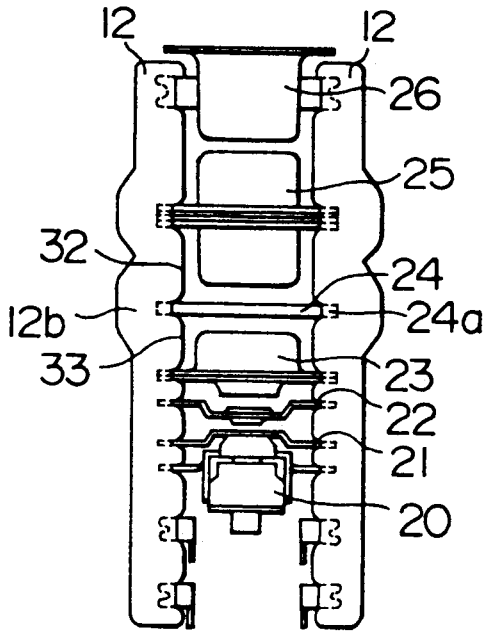
FIG. 8 is a front view of an electron gun of the second embodiment manufactured by the method of the present invention.

An electron gun according to the second embodiment and its modification is manufactured by the similar process to the first embodiment of the invention. FIG. 8 illustrates the manufactured electron gun having the above-mentioned structure of the second embodiment and its modification.

Figure 9:
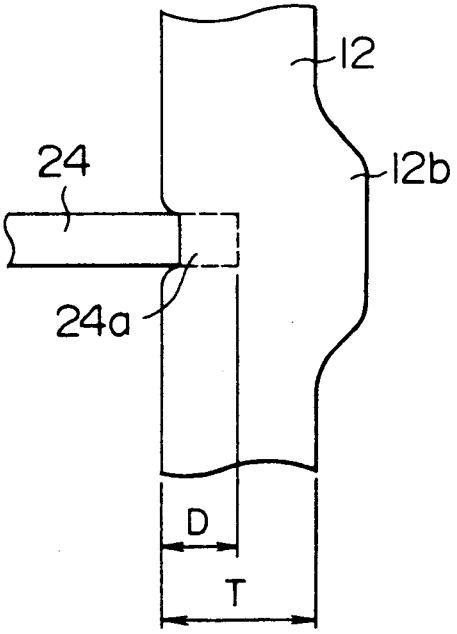
FIG. 9 is a fragmentary enlarged view of a portion of the electron gun of FIG. 1.

When manufacturing the electron gun, as shown in FIG. 9, a depth D of the bead support 24*a* for the $G_4$-electrode 24 which is buried in the bead glass is preferably predetermined in a range between 30% and 70% with respect to a total thickness T of the bead glass. In other words, the following relation can be derived:

$$0.3 \leqq D/T \leqq 0.7$$

In case of $D/T < 0.3$, a strength for supporting the electrodes is weakened, and on the contrary, in case of $D/T > 0.7$, the bead glasses often tend to crack.

According to the present invention, minimization of the recess and projection on the buried interface of the bead glass on its electrode side causes the supporting strength of the electrodes to be further improved, so that the electrodes can be retained with certain intervals therebetween, thereby increasing a focus performance of the electron gun. Further, in the knocking process during manufacture of color cathode-ray tubes, the electron gun is protected from the withstand voltage deterioration caused by produced spark, whereby a yield in the manufacturing process of the electron gun is maximized.

What is claimed is:

1. A method for manufacturing an electron gun retaining a cathode and a plurality of electrodes with bead glasses, wherein each of said bead glasses are provided with a convex portion at a portion on its electrode side where at least one bead support for an electrode is buried, said bead glasses disposed on bead bases of a beading apparatus are heated and softened, and bead supports for the cathode and the plurality of electrodes are buried and secured in the bead glasses.

2. A method for manufacturing an electron gun according to claim 1, characterized in that each of said bead bases is provided with a concave portion at a portion corresponding to the convex portion of the bead glass, and convex portions are formed on the bead glasses on their sides opposite to the electrodes by said bead support buried and secured in the bead glass, within said concave portions of the bead bases.

3. A method for manufacturing an electron gun, according to claim 2, characterized in that when said bead glasses each include at least two convex portions, the same number of concave portions as that of said convex portions are provided on said bead bases.

4. A method for manufacturing an electron gun, according to claim 2, characterized in that when said bead glasses each include at least two convex portions, said concave portions of the bead bases are large enough to receive all convex portions formed by said buried and secured bead supports on sides of the bead glasses opposite to the electrodes.

5. A method for manufacturing an electron gun, according to claim 2, characterized in that a depth of said bead support which is buried in said bead glass is predetermined in a range between 30% and 70% with respect to a thickness of the bead glass.

6. An electron gun comprising a cathode and a plurality of electrodes, and bead glasses for retaining said cathode and the plurality of electrodes, wherein each of said bead glasses is provided with a convex portion on its side of the electrodes at a portion where at least one bead support for an electrode is buried, the bead glasses disposed on bead bases of a beading apparatus are heated and softened, and the bead supports for the cathode and the plurality of electrodes are buried and secured in the bead glasses, whereby the surfaces once buried on the electrode sides of the bead glasses have at least the same heights as those before the cathode and the plurality of electrodes are buried and secured therein, and a strength of supporting the electrodes is increased, and withstand voltage characteristic of the electron gun is maximized.

7. An electron gun according to claim 6, characterized in that said bead glasses each include a convex portion at a portion corresponding to the position of the convex portion on the electrode sides as well as on a side of the bead glass opposite to the electrodes, thereby maximizing the strength of supporting the electrodes.

8. An electron gun according to claim 6, characterized in that a depth of said bead support which is buried in said bead glass is predetermined in a range between 30% and 70% with respect to a thickness of the bead glass.

* * * * *